US010585401B2

(12) United States Patent
Abo El-Fotouh

(10) Patent No.: US 10,585,401 B2
(45) Date of Patent: Mar. 10, 2020

(54) METHOD FOR DETERMINING A MASTER TIME SIGNAL, VEHICLE, AND SYSTEM

(71) Applicant: Bayerische Motoren Werke Aktiengesellschaft, Munich (DE)

(72) Inventor: Mohamed Abo El-Fotouh, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 15/241,429

(22) Filed: Aug. 19, 2016

(65) Prior Publication Data

US 2016/0357159 A1 Dec. 8, 2016

Related U.S. Application Data

(63) Continuation of application No. PCT/EP2015/051763, filed on Jan. 29, 2015.

(30) Foreign Application Priority Data

Feb. 20, 2014 (DE) ..... 10 2014 203 059

(51) Int. Cl.
*G04R 20/00* (2013.01)

(52) U.S. Cl.
CPC ..... *G04R 20/00* (2013.01)

(58) Field of Classification Search
CPC ..... G04R 20/00
See application file for complete search history.

(56) References Cited

U.S. PATENT DOCUMENTS 5,724,316 A * 3/1998 Brunts ..... G01C 21/3697 340/988
7,430,473 B2 9/2008 Foo et al.
8,009,519 B2 * 8/2011 Jazra ..... G01S 19/25 368/46
2002/0191492 A1 * 12/2002 Kamper ..... G04G 9/0076 368/47

(Continued)

FOREIGN PATENT DOCUMENTS

CN 1760931 A 4/2006
CN 1870490 A 11/2006

(Continued)

OTHER PUBLICATIONS

English Translation of EP1452934.*

(Continued)

*Primary Examiner* — Edwin A. Leon
*Assistant Examiner* — Jason M Collins
(74) *Attorney, Agent, or Firm* — Crowell & Moring LLP

(57) ABSTRACT

A method is provided for determining a master time signal, in particular in a vehicle. The method includes the acts of: a) receiving at least one first server time signal from a first time server; b) receiving at least one second server time signal from a second time server; c) comparing the first server time signal with the second server time signal in order to determine at least one first time difference; d) storing the first time difference; e) determining an availability of the first server time signal and/or of the second server time signal; f) using the stored first time difference to determine the master time signal at least if at least one of the server time signals is not available.

15 Claims, 1 Drawing Sheet

(56) References Cited

U.S. PATENT DOCUMENTS

| | | | | |
|---|---|---|---|---|
| 2009/0271110 | A1 | 10/2009 | Sugiura | |
| 2012/0207029 | A1* | 8/2012 | Kanda | H04L 43/0805 370/242 |
| 2015/0180641 | A1* | 6/2015 | Ogawa | G04R 20/06 375/354 |

FOREIGN PATENT DOCUMENTS

| | | | | |
|---|---|---|---|---|
| CN | 101031455 | A | 9/2007 | |
| CN | 101722912 | A | 6/2010 | |
| CN | 102023567 | A | 4/2011 | |
| CN | 102204396 | A | 9/2011 | |
| CN | 102356595 | A | 2/2012 | |
| CN | 102469569 | A | 5/2012 | |
| CN | 102754369 | A | 10/2012 | |
| CN | 102957488 | A | 3/2013 | |
| DE | 103 08 232 | A1 | 9/2004 | |
| EP | 1 452 934 | A2 | 9/2004 | |
| GB | 2 428 113 | A | 1/2007 | |
| JP | 2008-189211 | A | 8/2008 | |
| WO | WO 00/38169 | A1 | 6/2000 | |
| WO | WO 2009/008585 | A1 | 1/2009 | |
| WO | WO2014206836 | * | 6/2014 | G04R 20/02 |

OTHER PUBLICATIONS

Machine Translation of Foreign Patent Document (Year: 2014).*

International Search Report (PCT/ISA/210) issued in PCT Application No. PCT/EP2015/051763 dated Sep. 14, 2015 with English-language translation (six (6) pages).

German-language Written Opinion (PCT/ISA/237) issued in PCT Application No. PCT/EP2015/051763 dated Sep. 14, 2015 (seven (7) pages).

German Search Report issued in counterpart German Application No. 10 2014 203 059.5 dated Feb. 5, 2015 with partial English-language translation (fourteen (14) pages).

Chinese Office Action issued in Chinese counterpart application No. 201280049376.0 dated Sep. 28, 2015, with partial English translation (Seven (7) pages).

Chinese Office Action issued in Chinese counterpart application No. 201580009374.2 dated Jun. 15, 2018, with partial English translation (Ten (10) pages).

Chinese Office Action issued in Chinese counterpart application No. 201580009374.2 dated Nov. 21, 2018, with partial English translation (Sixteen (16) pages).

* cited by examiner

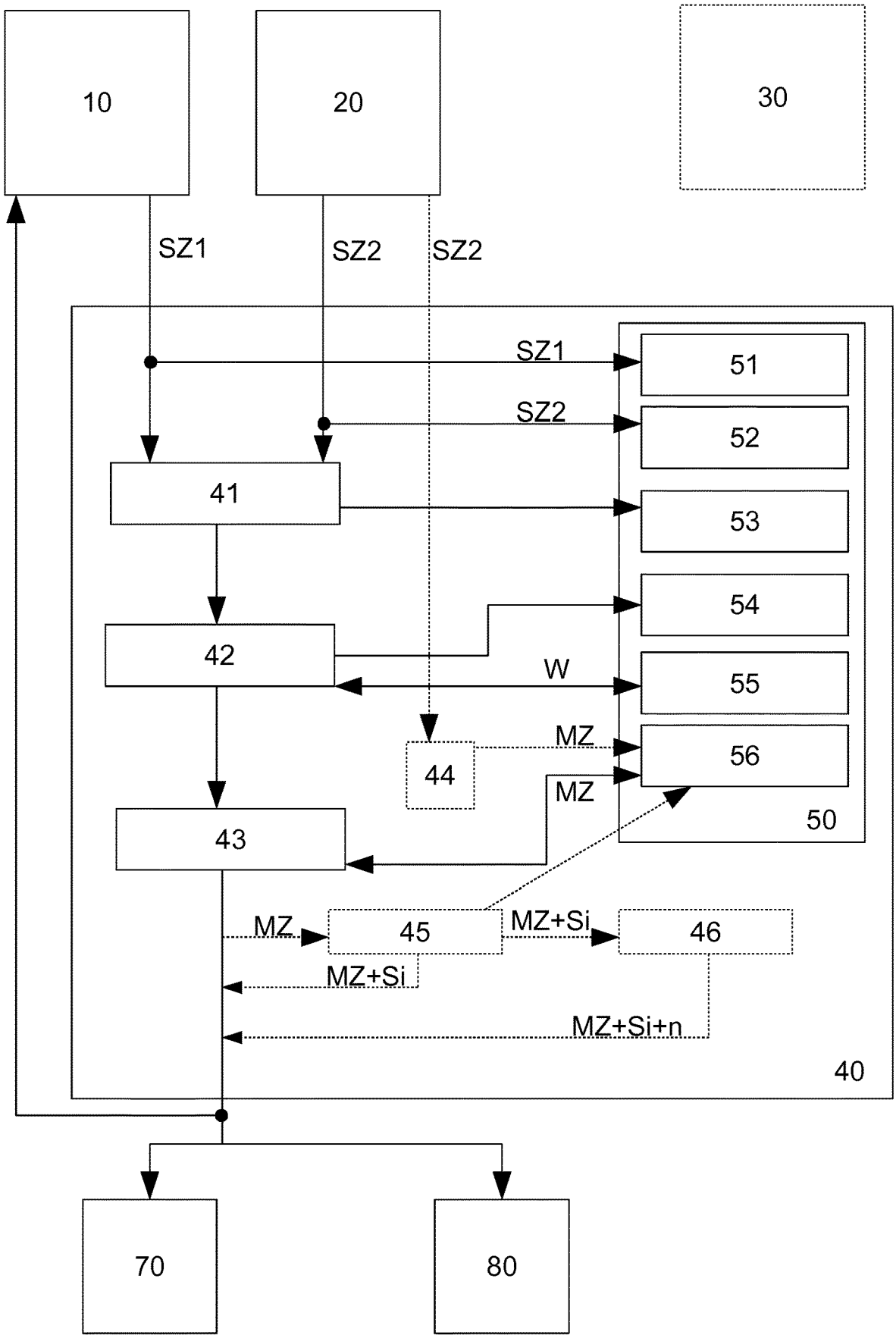
10
20
30
SZ1
SZ2
SZ2
SZ1
SZ2
51
52
41
53
54
42
W
55
MZ
56
44
MZ
50
43
MZ
45
MZ+Si
46
MZ+Si
MZ+Si+n
40
70
80

METHOD FOR DETERMINING A MASTER TIME SIGNAL, VEHICLE, AND SYSTEM

CROSS REFERENCE TO RELATED APPLICATIONS

This application is a continuation of PCT International Application No. PCT/EP2015/051763, filed Jan. 29, 2015, which claims priority under 35 U.S.C. § 119 from German Patent Application No. 10 2014 203 059.5, filed Feb. 20, 2014, the entire disclosures of which are herein expressly incorporated by reference.

BACKGROUND AND SUMMARY OF THE INVENTION

The invention relates to a method for determining a master time signal, in particular in a vehicle. In addition, the invention relates to a vehicle as well as a system with a vehicle.

It is already known that vehicles are equipped with storage media that record the occurrence of errors. Also, accidents can be documented with appropriate memory recordings. With these recordings, it is especially important that the exact time of the occurrence of the error and/or the exact time of the accident is recorded.

Furthermore, it is essential, for example for the sale of time-limited licenses such as those available for the map data of navigation devices that the product and/or the data is no longer available after the licensing period has expired. Until now, it has been quite conceivable to violate the license by manipulating the time information in a vehicle.

At the present time, known time determination systems in vehicles, such as using the GPS time, for example, are not continuously reliable time sources. GPS signals, for example, can be received only by vehicles having a communications device or a navigation system. In addition, GPS signals often cannot be received in home or commercial parking garages. A back-end (central conversion server) of a vehicle also cannot provide a reliable time signal at all times because a network connection to the back-end can also be interrupted.

Proceeding from this prior art, the object of the present invention is to provide a method that facilitates the determination of a safe and reliable time base for the vehicle. Furthermore, a correspondingly equipped vehicle as well as a system with such a vehicle is to be provided.

This and other objects are achieved with a method for determining a master time signal, in particular in a vehicle, comprising the acts of:

a) Receiving at least one first server time signal from a first time server;

b) Receiving at least one second server time signal from a second time server;

c) Comparing the first server time signal with the second server time signal to determine at least one first time difference;

d) Storing the first time difference;

e) Determining the availability of the first server time signal and/or the second server time signal;

f) Using the stored first time difference to determine the master time signal, at least when at least one of the server time signals is not available.

Thus, the server time signals of at least two time servers are used to determine a master time signal, wherein in a first determination step, the two time servers are compared with one another and the deviation from one another, that is to say the time difference between the two server time signals, is determined.

This first time difference is stored for the time being or stored in the interim so that in an additional step, the availability of the respective time servers can be determined. In a further step, the master signal is determined using the stored first time difference, so that, for example, an averaged time signal forms the master time signal. Such a master time signal is determined and/or calculated at least if at least one of the server time signals is not available. Even if all time servers are available, the time difference can improve the quality of the master time signal.

Theoretically, it is contemplated that the master time signal, at the time it is determined, is defined as a system time signal. This is to say that the first time server and the second time server can receive the master time signal, wherein the first time server and/or the second time server, in the case of a correspondingly deviating first server time signal and/or a correspondingly deviating second server time signal, synchronize their times based on the transmitted master time signal.

The method according to the invention provides that in a further step g), the master time signal and/or at least one first and/or second server time signal are stored in a memory. Preferably, the master time signal and/or at least one first and/or second server time signal are stored in encrypted form.

In an additional step h), it may be provided that the determined and/or calculated master time signal is transmitted to at least one control device and/or Electronic Control Unit (ECU) of a vehicle electrical system so that the control device and/or control devices adapt the master time signal as the control device and/or control device time signal. Such ECUs may be, for example, a navigation system that is operated with time-limited licensed software. Theoretically, it is also possible that the master time signal is transmitted to recording devices in the sense of a black box or to devices used for detecting accidents and/or for triggering an emergency call.

At least one of the method steps a) to h) is preferably repeated periodically. This means that determining a master time signal and the reception of a first and a second server time signal related thereto can occur at regular time intervals so that a reliable master time signal is continually determined. Thus, this pertains in particular to the steps a) to f). Likewise, the subsequent method steps g) and h) can be periodically repeated so that, for example, the transmission of the master time signal to various control devices and/or ECUs is continually transmitted at such a time interval in as far as this is required by a control device and/or ECU. Repeating the method steps a) to h) and/or the method steps a) to f) can also occur on an irregular basis, for example after a trigger signal and/or activation signal, which means in a triggered fashion. A trigger and/or activation signal can be sent by a control device and/or ECU, for example, if the control device and/or ECU requires a current master time signal.

The transmission of the master time signal to a so-called black box would thus be required at shorter time intervals than the transmission of the master time signal to a clock display located in the cockpit of the vehicle. With such a clock display, it is usually not necessary that the outputted time is 100% correct. A reliable master time signal can be transmitted to the respective control devices, which increments the master time signal.

The transmission of the master time to signal ECUs of the vehicle electrical system can occur via an Ethernet, in particular a BroadReach Ethernet, a CAN bus, a LIN bus, a MOST bus and/or a FlexRay bus. Theoretically, it is contemplated that transmitting the master time signal to a plurality of control devices occurs during various time periods and/or in various time cycles.

According to the present method, it is possible that the determined master time signal differs from a time signal displayed in the vehicle, such as a clock display, for example. With the help of the present method, it is to be ensured that the master time signal and/or the related method combine adaptability and reliability. In this context, adaptability is to be understood such that it is made possible for a driver to set and/or change the clock displayed in a vehicle. In this context, the reliability of the master time signal is given in that a display clock activated for change and the related server time signal enter into the determination of the master time signal only to a limited extent.

Weights can be allocated to the at least first time server and the at least second time server, wherein the weights of the first time server and/or the second time server are used to determine the master time signal. The weights, preferably encrypted, are stored in a memory or can be stored in a memory. In other words, each time server of a vehicle is assigned a weight that is stored in a memory or can be stored in a memory. For example, the weight of a time server can relate to the reliability or manipulation safety and/or accuracy of the transmitted server time signals.

The weight is used to determine the master time signal so that the server time signal transmitted by a time server as a function of the weight is used in various ways and/or with different weighting to determine the master time signal. Accordingly, a settable clock display of the vehicle, for example, is attributed a lesser weight than a time signal transmitted by a back-end, for example. Other indicators for determining a weight of a time server are the possibility of manipulation attempts and/or the frequency of transmission failures in view of the server time signal to be transmitted by a time server to determine a master time signal, for example. In addition, the frequency of observed time leaps in connection with a time server can be used in mapping and/or assigning a weight.

A periodic or dynamic check or determination of the weight of a time server or the weights of a plurality of time servers can occur, and the checked and determined weights can be stored in a memory. It is contemplated that the weight of a time server and thus the server time signal sent by the time server can occur in connection with a determined time difference to the master time signal. In other words, the weight of a time server must be checked, for example, and possibly determined again, if the time difference of a server time signal rises periodically relative to the master time signal. A determined manipulation attempt can also trigger the checking of a weight. The determination of time leaps and/or losses with respect to the accuracy of a server time signal associated with a time server are reason for checking a weight. In summary, a check/determination of a weight/the weights can occur if manipulation attempts and/or time leaps and/or transmission failures are determined on a/the time server.

Storing the master time signal and/or at least one server time signal in a memory can be done periodically. The periodicity can be established, for example, in that the storing of the time signals occurs when a system or a device used for determining a master time basis is switched off. It is also possible to determine and/or establish a storage interval. The stored master time signal can be secured against manipulation. This can occur by storing the master time signal on security hardware. The encryption of the stored time signals, in particular the encrypted storing of the time signals, also serves to protect against manipulation. The use of a hardware security module (HSM) or an internal or external peripheral device to ensure the trustworthiness and integrity of stored master time signals, of server time signals, of weights and/or of time differences is contemplated.

The transmission of a master time signal to one or a plurality of time servers is preferably conducted via a secure data connection, in particular an encrypted and/or signed data connection. To verify the integrity as well as the origin of the transmitted master time signal, the transmission can occur on the basis of message authentication code (MAC) algorithms. In this way, it can be avoided that the master time signal is manipulated during the transmission to a time server and the time server receives manipulated time signals. The transmission of a first server time signal and/or a second server time signal to determine a master time signal can also occur via a secure data transfer and/or data connection so that the server time signals cannot be manipulated and/or changed during transmission to a master time signal unit so that the determination of a master time signal is based on unmanipulated and/or unchanged server time signals.

The at least first time server and/or the at least second time server can be a mobile terminal device such as a mobile phone, laptop, handheld or tablet computer. It is furthermore possible that the first time server and/or the second time server is a navigation system, a vehicle clock, a radio device, a GPS receiver and/or a back-end. Accordingly, the first server time signal and/or the second sever time signal can be received proceeding from a mobile terminal device, a navigation system, a vehicle clock, a radio device and/or a back-end.

In addition, a calibration step may be provided. In such a calibration step, the server time signal can be received by the back-end of the vehicle, wherein the server time signal is defined as master time signal in the calibration step. The time signal transmitted by a back-end is therefore a reliable time signal provided with the highest weight so that at a first point in time, that is to say a calibration step, the master time signal is determined by receiving a time signal from the back-end. During such a calibration step, it is contemplated that the master time signal is compared with the first server time signal and/or the second server time signal and the weight/the weights are determined as a function of the determined time difference(s) to the master time signal.

The calibration step can occur in the scope of an offline operation, that is to say during a phase in which no master signal has to be determined or, for example, the vehicle is turned off and is not being moved. In the scope of such a calibration step, the time difference(s) of the server time signal(s) can be ranked with respect to the size of the time difference so that differently increasing weights are assigned to the time servers depending on the ranking.

The weights of the time servers can be determined heuristically, that is to say in connection with empirical values regarding the probability or the assumption with respect to a manipulation attempt. In as far as manipulations are determined, the weight of the corresponding manipulated time server can be decreased or set to zero. In a subsequent determination of a master time signal, the server time signal transmitted by the time server that was assigned a weight "zero" is not used.

When storing a master time signal and/or when transmitting the master time signal to at least one control device and/or when transmitting the master time signal to at least one time server, the master time signal can be provided with encryption and/or a signature. In addition to the signature, the master time signal can be provided with a counter. A time server, a memory and/or a control device checks the received master time signal first using the signature and, preferably, moreover using the counter. Thus, the counter must increase periodically with each transmitted master time signal so that a manipulation and/or the integrity of the master time signal can be checked using the counter. Thus, it is not possible for the counter to remain the same or to decrease in case of master time signals transmitted multiple times. Furthermore, the transmitted master time signal is checked for time leaps and/or counter leaps so that the integrity can also be checked using these indicators.

In addition, a reset process is possible with respect to determining a master time signal so that, when manipulation attempts and/or system failures are found, the master time signal can be set to the setting of the last unmanipulated state or the last checked setting. It is also possible to restore the server time signals after failures and/or manipulations by transmitting a master time signal from the memory.

It is further contemplated that the method does not influence the master time signal due to automatic time changes as are possible due to different time zones or the conversion to/from daylight savings time. Such a time change or conversion can only influence the time difference.

The aforementioned object is furthermore attained with a vehicle, wherein the vehicle comprises

- a bus system for communication with at least one control device of the vehicle;
- at least one memory,
- a master time signal unit to determine a master time signal, which is configured to:
  - receive at least one first server time signal from a first time server,
  - receive at least one second server time signal from a second time server,
  - compare the first server time signal with the second server time signal to determine at least one first time difference and store the first time difference,
  - determine the availability of the first server time signal and/or the second server time signal, and
  - use the stored first time difference to determine the master time signal at least when at least one of the server time signals is not available,
- wherein in the at least one memory, the master time signal, the first server time signal, the second server time signal and/or a first time difference between the first server time signal and the second server time signal is stored.

The bus system for communication with at least one control device of the vehicle can be a CAN bus, a LIN bus, a MOST bus and/or a FlexRay bus.

This too results in similar advantages as those explained above with respect to the method.

Thus, the master time signal unit serves to receive the first server time signal from a first time server and a second server time signal from a second time server. In addition, the master time signal unit is configured in such a way that it compares the first server time signal with the second server time signal and determines a first time difference. The storage or interim storage of the first time difference is also activated by the master time signal unit. The memory can be comprised by the master time signal unit. It is also contemplated that it is a higher-level memory. In addition, the master time signal unit is configured such that it determines the availability of the first and/or the second server time signal. Finally, the stored first time difference is used to determine the master time signal using the master time signal unit. At least, this is done if at least one of the server time signals is not available.

The master time signal unit has one or a plurality of memories in which the master time signal, the first server time signal, the second server time signal and/or a first time difference between the first server time signal and the second server time signal is stored. The memory or memories described above can be a memory comprised by the master time signal unit. Theoretically, the development of one or a plurality of external memories is also contemplated.

It is also contemplated that the memory described above or an additional memory is provided, in which a weight/the weights of a/the first time server and/or a/the second time server is/are stored.

In the scope of the vehicle according to the invention, the at least first time server and/or the at least second time server is a navigation system, a GPS receiver, a vehicle clock and/or a radio device and/or a back-end.

The aforementioned object is furthermore attained with a system with a vehicle according to the invention. The system according to the invention is thus designed in such a fashion that it can execute the method according to the invention for the determination of a master time signal in a vehicle. It is feasible that the at least first time server and/or the at least second time server of the system is a mobile terminal device, such as, for example, a laptop, handheld, tablet or smart phone. Here too, the resulting advantages are similar to those explained earlier.

The object according to the invention is furthermore attained with a computer-readable storage medium having executable program code that prompt a computer or a processing unit to implement the described method when the program code is executed.

Other objects, advantages and novel features of the present invention will become apparent from the following detailed description of one or more preferred embodiments when considered in conjunction with the accompanying drawing.

BRIEF DESCRIPTION OF THE DRAWING

FIG. 1 is a schematic block diagram of an exemplary vehicle according to the invention for executing an exemplary method according to the invention for the determination of a master time signal. All transmission paths shown in dashed lines and/or the vehicle units shown in dashed lines are merely optional units and/or data connections.

DETAILED DESCRIPTION OF THE DRAWING

The vehicle shown in FIG. 1 includes a first time server 10, which transmits one first server time signal SZ1 to the master time signal unit 40. Furthermore, a second time server 20 is shown, which transmits one second server time signal SZ2 to the master time signal unit 40. Preferably, the transmission of the server time signals SZ1 and SZ2 occurs by way of a secured transmission channel.

The master time signal unit 40 receives the first server time signal SZ1 as well as the second server time signal SZ2, wherein in a comparer 41, a comparison occurs between the first server time signal SZ1 and the second server time signal SZ2 to determine at least one first time difference ZD.

The first time difference ZD can be stored in a time difference memory 53. The time difference ZD or in this case the first time difference is transmitted into the determination unit 42, wherein furthermore the availability of the first server time signal SZ1 and/or the second server time signal SZ2 occurs in the unit 42. The stored time difference ZD is used to determine the master time signal MZ. Such a determination of the master time signal MZ occurs at least when one of the server time signals SZ1 or SZ2 is not available. The availability of the two time servers 10 and 20 can be stored in a memory 54. In the shown example, the master time signal unit 40 has a transmission unit 43 for transmission of the previously determined master time signal MZ.

In the present case, the master time signal MZ is transmitted to a first control device 70 as well as to a second control device 80. In addition, it is provided that the master time signal MZ is transmitted to the first time server 10. The master time signal MZ is transmitted to the first time server 10 to synchronize the first time server 10.

In the present case, the master time signal unit 40 has a memory unit 50 with a plurality of sub-memories 51-56. In the memory 51, the first server time signals SZ1 of the first time server 10 are stored. In the memory 52, on the other hand, the second server time signals SZ2 of the second time server 20 are stored. As already mentioned earlier, in the memory 53, the time difference ZD is stored. In the memory 54, data with respect to server availability can be stored. The memory 55 is the memory for the weights W. Thus, weights W of the first time server 10 as well as weights W of the second time server 20 are stored in the memory 55. In the memory 56, the master time signal(s) MZ are stored.

In the present case, the first time server 10 is a vehicle clock. Thus, after the master time signal MZ has been determined, it can be transmitted to the vehicle clock. The second time server 20 is the back-end of the vehicle. Also shown is a third time server 30 to represent the random number of time servers and time server signals SZ3 to be transmitted.

The master time signal MZ is transmitted to a control device 70, which in the shown example is a navigation device, as well as to a control device 80, which is a protocol memory in terms of a black box.

The first time server 10 as well as the second time server 20 have assigned weights W that are used to determine the master time signal MZ. The weights W are preferably stored in the memory 55 in an encrypted fashion. The weights W can be checked and/or determined periodically or dynamically. In as far as the values with respect to the weights W of the first time server 10 and/or the second time server 20 are changed, they are stored again in the memory 55. This is done by way of overwriting the value in the memory 55. The check/determination of a weight W is preferably done when manipulation attempts, time leaps and/or transmission failures are found at the first and/or second time server 10/20.

In the present case, it can be assumed that the second time server (back-end) 20 is assigned a higher weight W than the first time server (vehicle clock) 10. With a back-end, a weighting of up to 100% can be assumed.

In a calibration step, the master time signal MZ can be received from the back-end and/or the second time server 20. The calibration unit 44 thus receives the second server time signal SZ2 from the second time server 20, which is to say the back-end, and stores the master time signal MZ in the memory 56. In the performed calibration step, the master time signal MZ, which in the calibration step corresponds to the second server time signal SZ2, is compared with the first server time signal SZ1 of the first time server 10. The calibration unit 44 determines the weight W of the first time server 10 as a function of the time difference ZD determined between the master time signal MZ and the first server time signal SZ1. As far as the weight W of the first time server 10 is equal to the weight W stored in the memory 55 in the comparison, the newly determined weight W does not have to be stored in the memory 55. If the weight W has changed, the newly determined weight W is stored in the memory 55 so that the initial weight W is overwritten, for example.

The check and/or determination of a weight W with respect to the first time server 10 preferably occurs when a manipulation attempt, a time leap and/or a transmission failure can be found on the time server 10, which is to say the vehicle clock.

Optionally, the system according to the invention can furthermore include a signature unit 45 and/or a counter 46. With the help of the signature unit 45, the determined master time signal MZ can be provided with a signature Si. Using such a signature, for example, the control device 70 can determine whether the master time signal MZ was manipulated. In addition, it is possible that the master time signal MZ is stored with a signature in the memory 56.

Additionally or alternatively, it may be provided that the master time signal unit 40 includes a counter unit 46. The counter unit 46 provides the determined master time signal MZ with a counter n, wherein this is possible for the master time signal MZ, as well as for the master time signal MZ+Si provided with a signature Si.

The recipient of the master time signal MZ+Si+n, which is to say the first time server 10, the control device 70 and/or the control device 80, can determine by way of the value of the counter n whether the master time signal was transmitted manipulation-free according to a continually increasing counter value. If the signature Si is erroneous, the counter value n remains the same and/or the counter value n decreases, it can be assumed that there was a manipulation attempt with respect to the transmitted master time signal MZ+Si+n.

LIST OF REFERENCE SYMBOLS

10 First time server
20 Second time server
30 Third time server
40 Master time signal unit
41 Comparer
42 Determination unit
43 Transmission unit
44 Calibration unit
45 Signature unit
46 Counter unit
50 Memory
51 Memory of first server time signal SZ1
52 Memory of second server time signal SZ2
53 Memory of time difference ZD
54 Memory of server availability
55 Memory weight W
56 Memory master time signal MZ
70 Control device
80 Control device
SZ1 First server time signal
SZ2 Second server time signal
SZ3 Third server time signal
MZ Master time signal
ZD Time difference
W Weight
Si Signature
n Counter The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for determining a master time signal in a vehicle, the method comprising the acts of:

a) receiving at least one first server time signal from a first time server;

b) receiving at least one second server time signal from a second time server, c) comparing the first server time signal with the second server time signal to determine at least one first time difference;

d) storing the first time difference;

e) determining an unavailability of the first server time signal and/or the second server time signal;

f) calculating the master time signal, at least in response to determining the unavailability of the first server time signal and/or the second server time signal, using the stored first time difference;

(h) transmitting the master time signal to at least one control device of the vehicle and to the first time server; and (i) operating the at least one control device and the first time server in accordance with the master time signal by adapting the master time signal as a time signal of the at least one control device and the first time server, respectively.

2. The method according to claim 1, further comprising the act of:

g) storing the master time signal and/or at least one of the server time signals in a memory.

3. The method according to claim 2, wherein the master time signal and/or the at least one server time signal are stored in an encrypted form.

4. The method according to claim 1, wherein acts a) to h) are repeated periodically or upon being triggered.

5. The method according to claim 1, wherein acts a) to f) are repeated periodically or upon being triggered.

6. The method according to claim 1, further comprising the acts of:

assigning weights to the first time server and the second time server; and using the assigned weights to determine the master time signal, wherein the assigned weights are stored in a memory.

7. The method according to claim 6, wherein the assigned weights are periodically or dynamically determined and stored in the memory.

8. The method according to claim 6, further comprising the act of:

checking a respective weight of a respective time server when a manipulation attempt, a time leap and/or a transmission failure is determined on the respective time server.

9. The method according to claim 1, further comprising the act of:

receiving the first server time signal and/or the second server time signal from a mobile terminal device, a navigation system, a vehicle clock, a radio and/or a back-end server.

10. The method according to claim 9, further comprising the act of:

performing a calibration in which a server time signal is received from the back-end server and is defined as the master time signal.

11. The method according to claim 10, wherein:

in performing the calibration, the master time signal is compared with the first server time signal and/or the second server time signal and weights assigned to the first time server and/or the second time server are determined as a function of a determined time difference relative to the master time signal.

12. A vehicle, comprising:

a bus system configured to communicate with one or more control devices of the vehicle;

a memory;

a master time signal unit that determines a master time signal, the master time signal unit being configured to:

receive a first server time signal from a first time server, receive a second server time signal from a second time server, compare the first server time signal with the second server time signal to determine a first time difference and to store the first time difference, determine an unavailability of the first server time signal and/or the second server time signal, calculate the master time signal, at least in response to determining the unavailability of the first server time signal and/or the second server time signal, using the stored first time difference, transmitting the master time signal to at least one control device of the vehicle and to the first time server, and operating the at least one control device and the first time server in accordance with the master time signal by adapting the master time signal as a time signal of the at least one control device and the first time server, respectively, wherein the master time signal, the first server time signal, the second server time signal and/or the first time difference is stored in the memory.

13. The vehicle according to claim 12, further comprising a memory in which a weight or weights of the first time server and/or the second time server are stored.

14. The vehicle according to claim 12, wherein the first time server or the second time server is a navigation system, a vehicle clock, a radio or a back-end server.

15. A system, comprising:

one or more mobile terminal devices, a vehicle, the vehicle comprising:

a bus system configured to communicate with one or more control devices of the vehicle;

a memory;

a master time signal unit that determines a master time signal, the master time signal unit being configured to:

receive a first server time signal from a first time server, receive a second server time signal from a second time server, compare the first server time signal with the second server time signal to determine a first time difference and to store the first time difference, determine an unavailability of the first server time signal and/or the second server time signal, calculate the master time signal, at least in response to determining the unavailability of the first server time signal and/or the second server time signal, using the stored first time difference, transmit the master time signal to at least one control device of the vehicle and to the first time server, and operate the at least one control device and the first time server in accordance with the master time signal by adapting the master time signal as a time signal of the at least one control device and the first time server, respectively, wherein the master time signal, the first server time signal, the second server time signal and/or the first time difference is stored in the memory, wherein the first time server and/or the second time server are formed by a respective mobile terminal device.

* * * * *